US010156095B1

(12) United States Patent
Keast et al.

(10) Patent No.: US 10,156,095 B1
(45) Date of Patent: Dec. 18, 2018

(54) TOP DRIVE AND POWER SWIVEL WITH HIGH PRESSURE SEALS AND AUTOMATIC REFILLING LUBRICATION RESERVOIR

(71) Applicants: Larry G. Keast, Houston, TX (US); David A. McMahon, Houston, TX (US)

(72) Inventors: Larry G. Keast, Houston, TX (US); David A. McMahon, Houston, TX (US)

( * ) Notice: Subject to any disclaimer, the term of this patent is extended or adjusted under 35 U.S.C. 154(b) by 0 days.

(21) Appl. No.: 15/459,937

(22) Filed: Mar. 15, 2017

(51) Int. Cl.

| | |
|---|---|
| ***E21B 3/02*** | (2006.01) |
| ***E21B 19/06*** | (2006.01) |
| ***F15B 11/08*** | (2006.01) |
| ***F15B 13/04*** | (2006.01) |
| *E21B 19/00* | (2006.01) |

(52) U.S. Cl.
CPC ..... *E21B 3/02* (2013.01); *E21B 19/06* (2013.01); *F15B 11/08* (2013.01); *F15B 13/0401* (2013.01); *E21B 19/008* (2013.01)

(58) Field of Classification Search
CPC ..... E21B 3/02–3/035
See application file for complete search history.

(56) References Cited

U.S. PATENT DOCUMENTS

| | | |
|---|---|---|
| 8,807,207 B1 | 8/2014 | Keast |
| 9,303,469 B1 | 4/2016 | Keast |

*Primary Examiner* — George Gray
(74) *Attorney, Agent, or Firm* — Buskop Law Group, P.C.; Wendy Buskop

(57) ABSTRACT

A top drive or a power swivel with a high pressure washpipe and seal assembly receives high pressure drilling fluid from a mud pump and provides high pressure drilling fluid to the drilling fluid side of a dual fluid reservoir. A separating piston in the dual fluid reservoir moves toward the oil side as hydraulic oil is used for lubrication. This dual fluid reservoir with separating piston provides hydraulic oil at drilling mud pressure as required by the set of unique high pressure seals which are continuously lubricated and which generate minimal heat.

8 Claims, 6 Drawing Sheets

TOP DRIVE AND POWER SWIVEL WITH HIGH PRESSURE SEALS AND AUTOMATIC REFILLING LUBRICATION RESERVOIR

FIELD

This invention relates to a top drive or a power swivel with a dual fluid reservoir which automatically lubricates a high pressure washpipe dual seal assembly. The reservoir is automatically refilled from an existing source of lubricant onboard the top drive or power swivel hanging in a derrick and does not require an additional long hose or more than four long hoses total from a remote hydraulic power unit.

BACKGROUND

The present invention is related to oilfield top drives and power swivels, each of which employs a washpipe dual seal assembly to contain high pressure drilling fluids.

Conventional seal assemblies are heat generating by nature and are typically rated to contain 5000 psi but in practical application will only support that pressure level for brief periods such as 5 hours.

A need exists for a top drive or power swivel with a washpipe dual seal assembly capable of containing much higher pressures reliably, for example 10,000 psi for hundreds of hours.

A need exists for an automatic lubricating seal assembly which does not require manual refilling or an additional long hose or more than 4 long hoses total from a remote hydraulic power unit.

BRIEF DESCRIPTION OF THE DRAWINGS

The detailed description will be better understood in conjunction with the accompanying drawings as follows.

Figure 1:
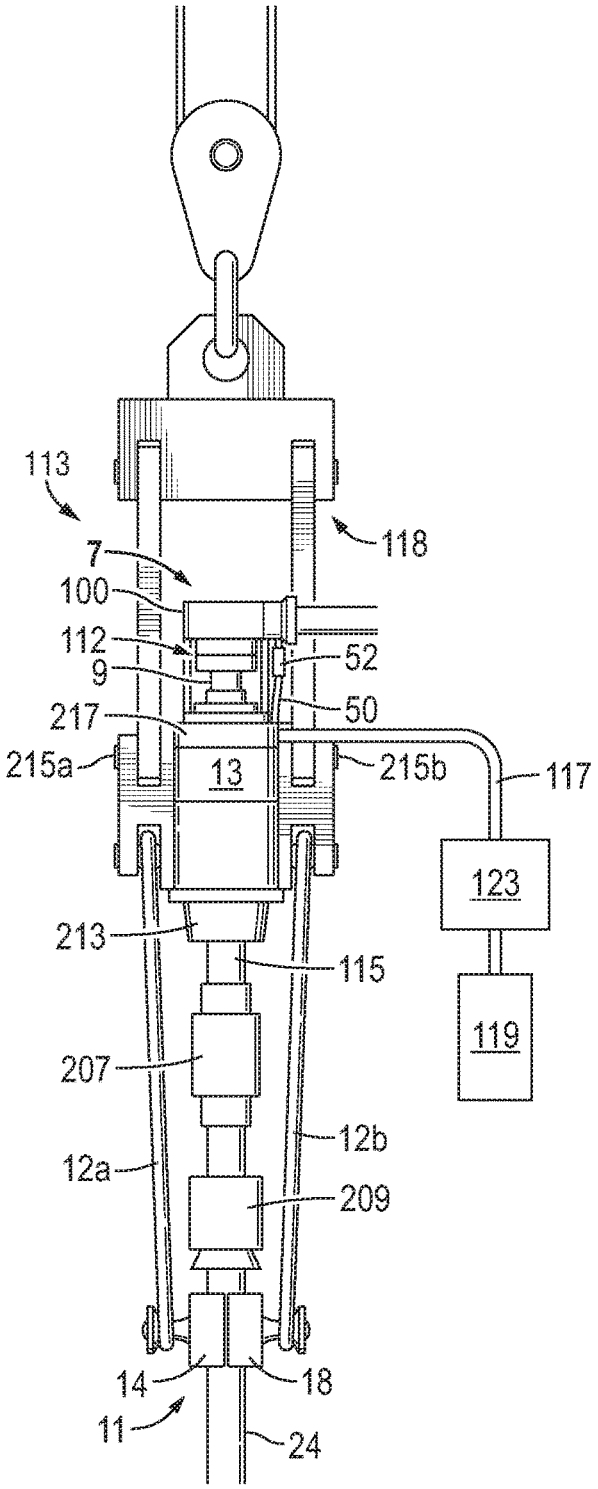
FIG. 1 is a front view of a top drive with an embodiment of the invention.

The present embodiments are detailed below with reference to the listed Figures.

DETAILED DESCRIPTION OF THE EMBODIMENTS

Before explaining the present apparatus in detail, it is to be understood that the apparatus is not limited to these particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The invention relates to a top drive or a power swivel with a washpipe dual seal assembly for conducting drilling fluid from a mud pump down through the stem of the top drive or power swivel.

This drilling fluid is also conducted into a dual fluid reservoir built into the top of the power swivel or top drive.

The dual fluid reservoir has an oil side for containing hydraulic oil and a mud side for containing drilling mud.

A separating piston in the dual fluid reservoir is free floating so has equal pressure on each side.

The separating piston moves to reduce the oil side displacement as hydraulic oil is used for lubrication and moves to a larger displacement as hydraulic oil is refilled.

The dual seal assembly uses a partitioning seal to separate drilling mud from hydraulic oil without a differential pressure across the seal, and a high pressure seal to separate hydraulic oil from outside air at a full differential pressure across the seal.

Each seal is in sealing engagement with the sealing surface of the rotating washpipe.

In operation, drilling mud contacts one side of the partitioning seal.

Hydraulic oil at equal pressure to the drilling mud simultaneously contacts the other side of the partitioning seal.

The partitioning seal keeps the equally pressured hydraulic oil and drilling mud apart.

Hydraulic oil contacts the one side of the high pressure seal, and outside air contacts the other side of the high pressure seal.

The high pressure seal separates high pressure oil from outside air at atmospheric pressure.

The hydraulic oil flows from an oil side of a dual fluid reservoir built in to a bonnet and reservoir housing which also encloses a washpipe dual seal assembly.

A separating piston is floating in the dual fluid reservoir to separate the hydraulic oil and drilling mud.

The separating piston of the dual fluid reservoir moves to reduce oil side displacement as oil is used to lubricate the dual seal assembly.

The separating piston also moves to accommodate oil volume change from thermal expansion and contraction.

The following terms are used herein:

The term "drilling mud" is also referred to as drilling fluid herein.

The term "drill pipe" as used herein can refer to any piece of equipment required to be positioned or moved by the elevator of a top drive. The embodiments shown make use of an API standard drill pipe as used in oilfield applications.

The term "elevator" refers to the lowest element of the top drive that lifts the drill pipe.

The term "hose" can refer to any fluid conduit used for supplying hydraulic fluids or other fluids to and from a power swivel or top drive.

The term "link" can refer to members of a top drive which suspend the elevator.

The term "seal" as used herein is not meant to imply a perfect separation of the two fluids, as many different types of dynamic seals have small but acceptable leak rates.

For example, the type of packing most commonly used in oilfield washpipe packings (see U.S. Pat. No. 2,764,428) has a slow but acceptable leak rate that is apparently related to the surface texture created by fabric reinforcement of the elastomer used to form the packing. For another example, the Kalsi Engineering owned U.S. Patent Publication Number 2016035682, incorporated herein by reference, which teaches that their seals are designed to have slow leak rates to lubricate the seal as the washpipe rotates inside it.

Turning now to the Figures, FIG. 1 shows a top drive 7 with a rotary wash pipe 9 fluidly connected to a mud pump (not shown) for receiving drilling mud from a mud pump.

The top drive 7 has a motor assembly 13.

The top drive 7 has an elevator 11 suspended from a pair of links 12*a*, 12*b* for supporting drill pipe 24.

The elevator 11 of the top drive has a pair of elevator segments 14 and 18.

Figure 3:
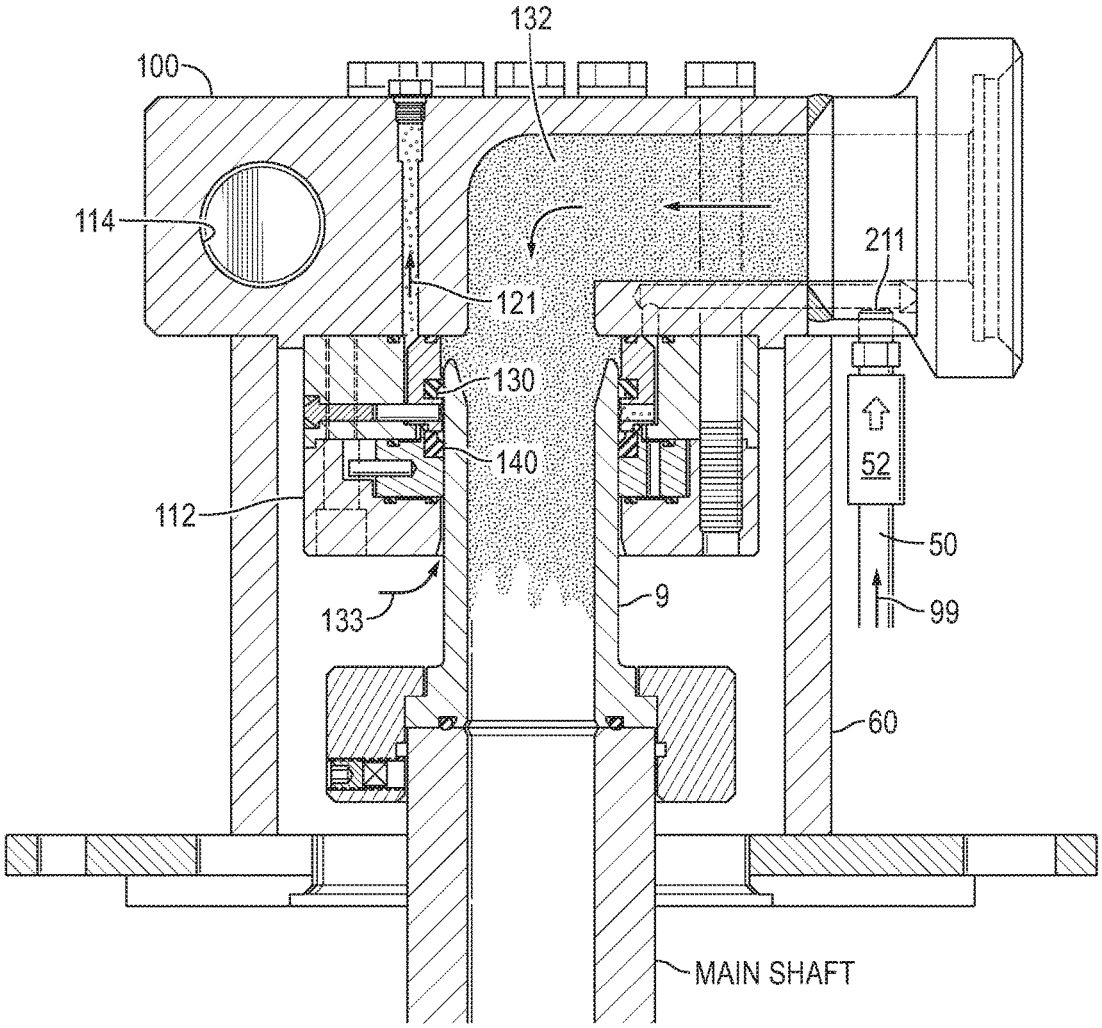
FIG. 3 is a detailed view of the dual seal assembly and washpipe as installed in a bonnet and reservoir housing mounted on a top drive.

A short hose 50 connects to a local source of hydraulic oil 99 onboard the top drive or power swivel (for example pressurized to 350 psi) (shown in FIG. 3).

A bonnet and reservoir housing 100 is mounted to the motor assembly 13 and a housing 113.

This figure shows lifting means 118 for engaging a hoist with the housing 113 connected to the lifting means 118.

Four long hoses 117 are represented in this figure for moving hydraulic oil.

The top drive has an internal blow out preventer 207 connected to stem 115 and a back up torque wrench 209 connected to housing 113 and engaging drill pipe 24.

The top drive has a brake 213 connected to the housing 113.

In addition the top drive has a pair of bail pins 215*a, b*, for securing the lifting means to the housing 113; and a hydraulic manifold 217 connects the onboard hydraulic oil source 99 207.

Additionally shown is a remote hydraulic power unit 119.

Figure 2:
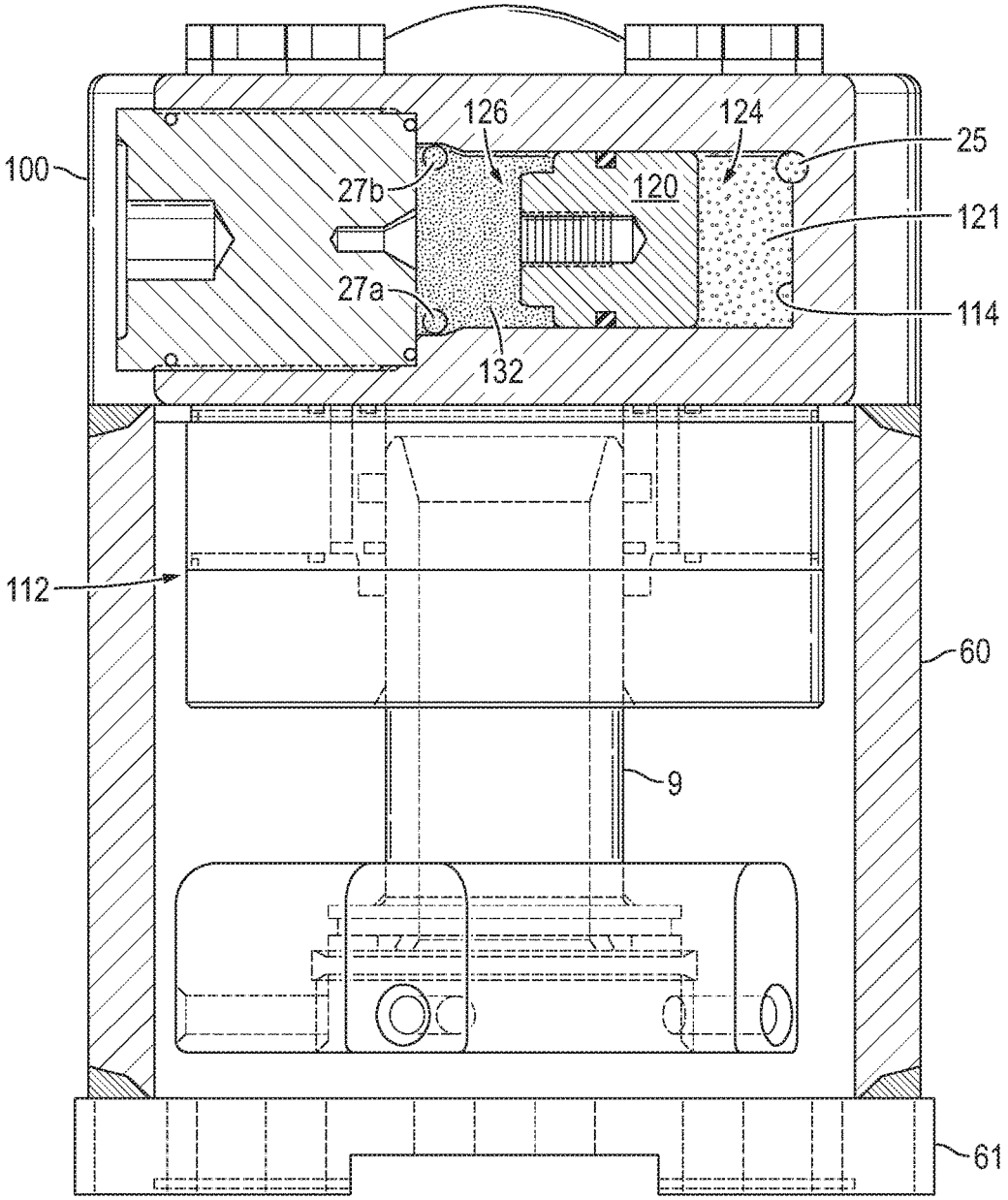
FIG. 2 is a cross sectional view of the bonnet and reservoir housing showing the dual fluid reservoir.

FIG. 2 shows a detail of the bonnet and reservoir housing 100 showing a cross-section detail of the dual fluid reservoir.

The bonnet and reservoir housing 100 contains a dual fluid reservoir 114 with an oil side 124 for containing hydraulic oil 121 and a mud side 126 containing drilling mud 132.

The dual fluid reservoir has a separating piston 120 positioned between the oil side 124 and mud side 126.

The separating piston is configured to move as hydraulic oil depletes while maintaining equal pressure for hydraulic oil and drilling mud.

The hydraulic oil refills automatically from the local onboard hydraulic oil source and short hose without requiring an additional long hose or more than four long hoses total or a hose reel with more than four hoses to the remote hydraulic power unit 119.

The local onboard hydraulic oil source 99 automatically refills the dual fluid reservoir each time the drilling fluid pressure is turned off or is reduced below the pressure of the hydraulic oil source.

The oil refill occurs automatically because low pressure oil is always available when the system is running and because mud pump pressure is always turned off regularly during drilling operations.

FIG. 2 also depicts the drilling mud entering through a pair of mud ports 27*a* and 27*b* into the mud side.

The lower port 27*a* allows mud drainage by gravity so that hardened mud does not restrict piston movement after a long period of time, and the upper port 27*b* allows air to escape when filling with mud.

Hydraulic oil 121 enters through an oil port 25 into the oil side of the dual fluid reservoir.

FIG. 2 shows that the bonnet and reservoir housing 100 can include a support 60 that engages a bottom flange 61 which is used to attach the bonnet and reservoir housing to the top drive.

FIG. 2 shows the dual fluid reservoir 100 fluidly connects to a high pressure dual seal assembly 112 (shown in FIGS. 2 and 3) that provides a sealing engagement against the washpipe 9.

The dual seal assembly 112 fluidly connects to the oil side of the dual fluid reservoir 114.

The dual seal assembly has a wavy edged hydrodynamic partitioning seal that separates drilling mud from hydraulic oil without a differential pressure across the partitioning seal.

A wavy edged hydrodynamic high pressure seal separates hydraulic oil from outside air at atmospheric pressure while supporting a full differential pressure across the high pressure seal.

The invention operates such that the dual fluid reservoir 114 automatically refills the oil side as drilling mud pressure decreases below hydraulic oil pressure such as when the mud pump routinely turns off to connect joints of drill pipe.

FIG. 3 also shows the hydraulic oil 121, the drilling mud 132, the low pressure short oil hose 50 and the check valve 52 for allowing low pressure hydraulic oil to flow into the oil side of the dual fluid reservoir after which check valve 52 holds hydraulic oil at high pressure during drilling operations.

FIG. 3 depicts the bonnet and reservoir housing 100.

FIG. 3 also shows the dual seal assembly 112 with a dual fluid reservoir 114.

FIG. 3 shows a wavy edged hydrodynamic partitioning seal 130 separating drilling mud from hydraulic oil 121 without differential pressure across the partitioning seal as positioned against the washpipe 9, FIG. 3 shows a wavy edged hydrodynamic high pressure seal 140 separating hydraulic oil 121 from outside air 133 with full differential pressure across the high pressure seal; and wherein the oil side of the dual fluid reservoir is refilled automatically when drilling mud pressure decreases below the oil pressure.

The separating piston is positioned between the oil side and mud side and moves as hydraulic oil depletes while maintaining equal pressure of hydraulic oil and drilling mud.

Hydraulic oil refills an oil side automatically through a short onboard hose and a check valve from the local onboard hydraulic oil source 99 without requiring an additional long hose to supply hydraulic oil from a remote hydraulic power unit and without requiring more than a total of four long hoses or more than a 4 hose reel connected from the remote hydraulic power unit to the hydraulic motor assembly and wherein a refill of the hydraulic oil reservoir occurs each time the drilling fluid pressure is turned off or drops below oil pressure;

The support 60 that engages a bottom flange which is used to attach the bonnet and reservoir housing to the top drive is also depicted in this Figure.

Figure 4:
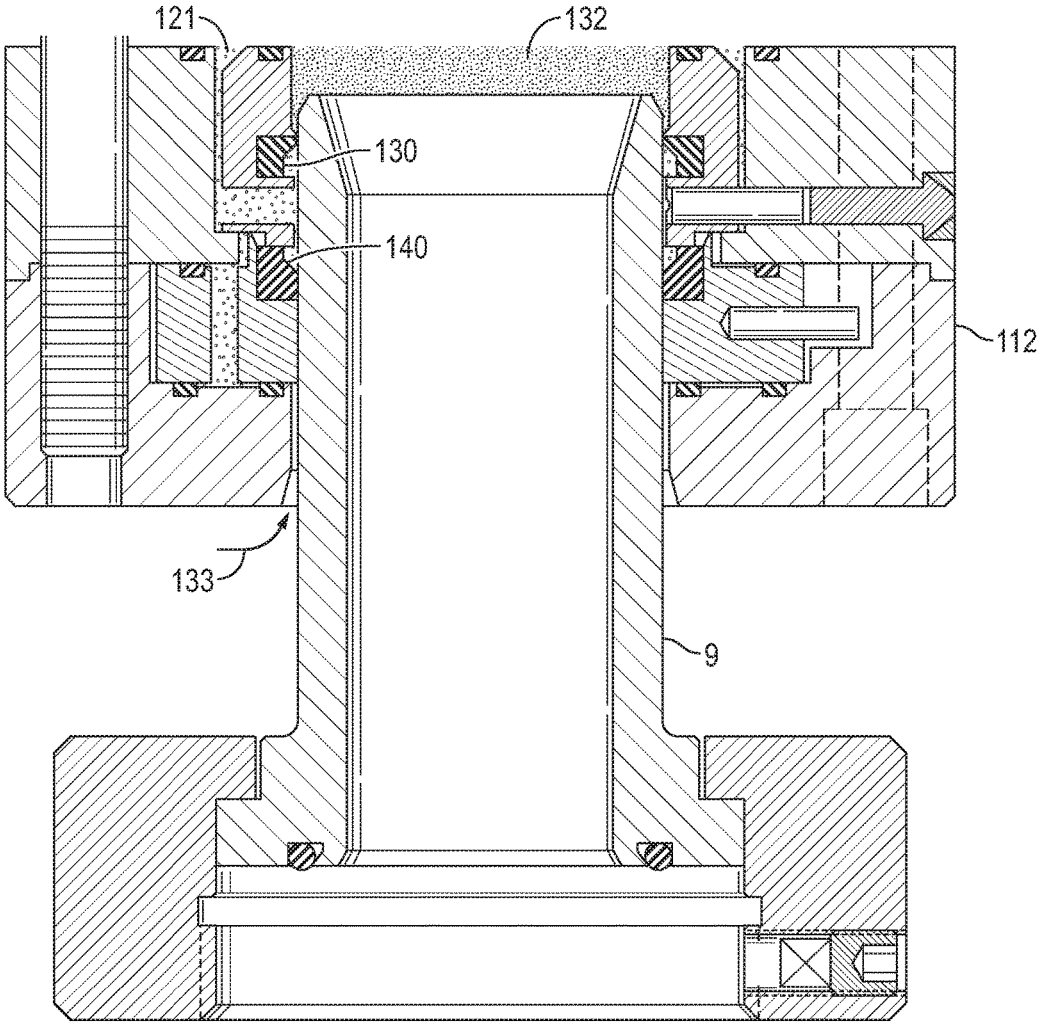
FIG. 4 is a further detailed view showing the dual seal assembly and washpipe.

FIG. 4 depicts a detail of the dual seal assembly 112 that surrounds washpipe 9.

A partitioning seal 130 separates drilling mud 132 from hydraulic oil 121 without differential pressure across the partitioning seal 130.

A high pressure seal 140 separates hydraulic oil 121 from outside air 133 while supporting high differential pressure.

Figure 5:
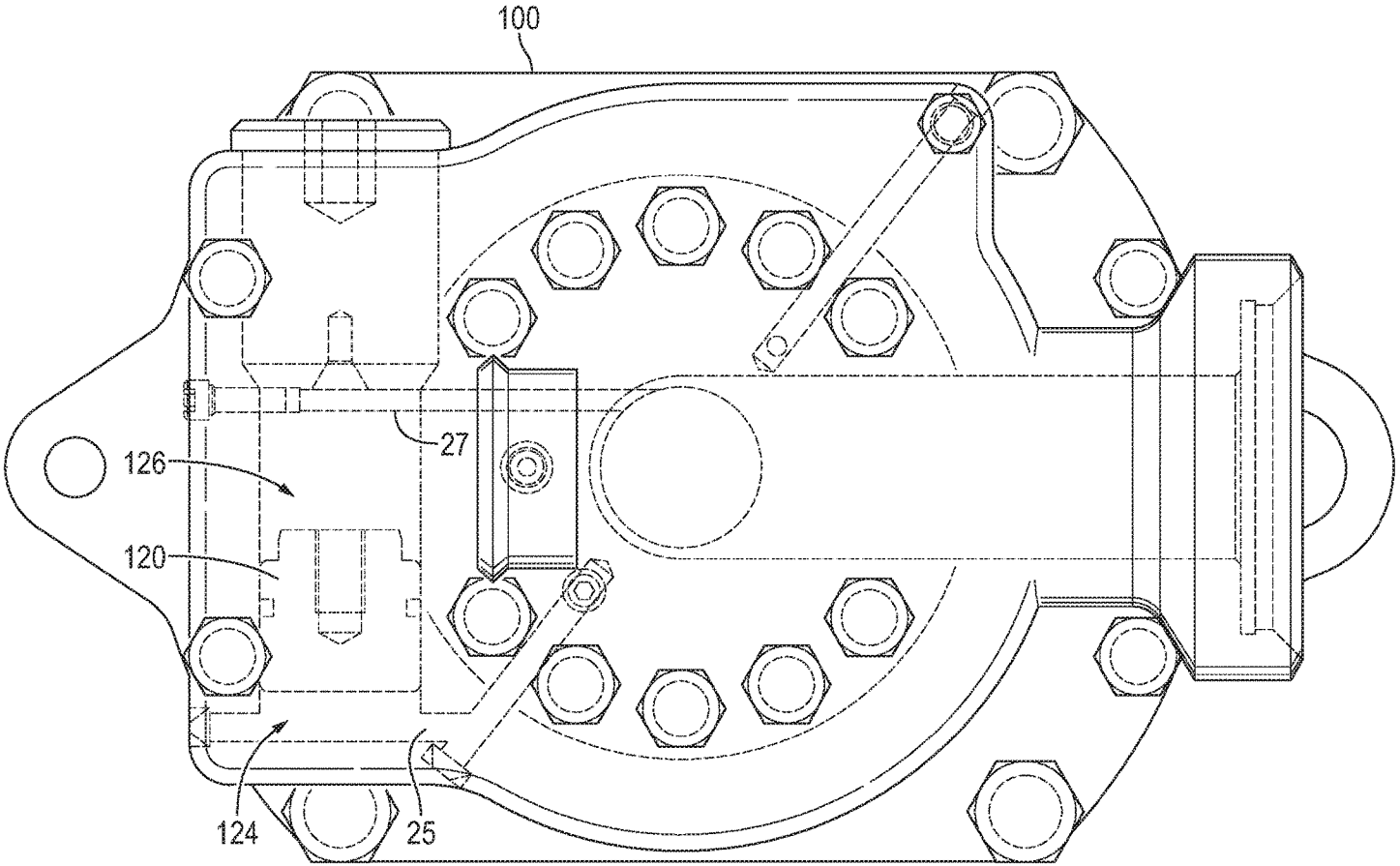
FIG. 5 is a top view of an embodiment of the invention.

FIG. 5 is a top view of the bonnet and reservoir housing 100.

The separating piston 120 is shown with the oil side 124 and the oil port 25 and the mud side 126 with one of the mud ports 27.

The separating piston is configured to move as hydraulic oil depletes while maintaining equal pressure of hydraulic oil and drilling mud; wherein the hydraulic oil refills automatically from the local onboard hydraulic oil source without requiring an additional long hose or more than four long hoses total to the remote hydraulic power unit and wherein a refill into the reservoir occurs each time the drilling fluid pressure is turned off or drops below oil pressure.

Figure 6:
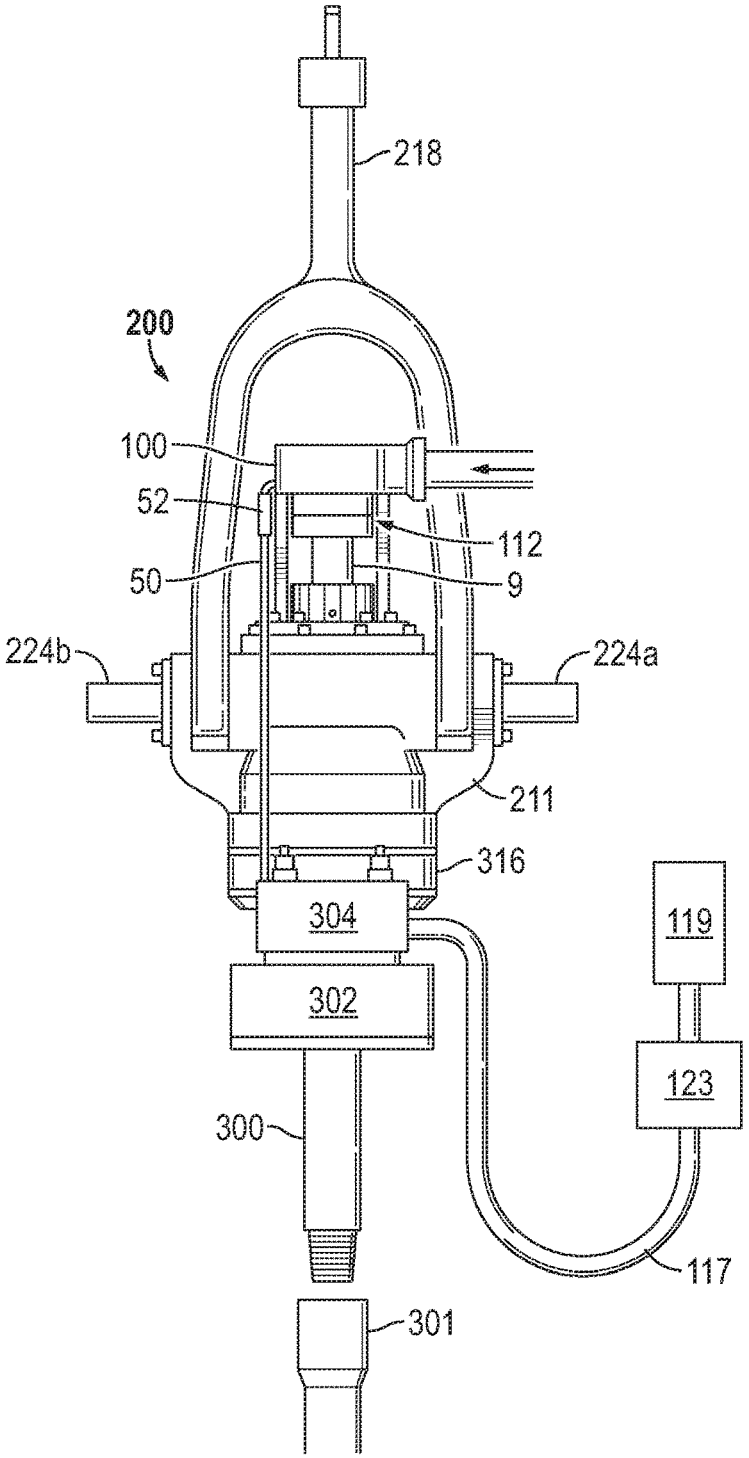
FIG. 6 is a front view of a power swivel with an embodiment of the invention.

FIG. 6 is a depiction of a power swivel assembly 200 according to the invention.

The power swivel assembly has a lifting means 218.

The power swivel housing 211 is shown engaging the lifting means 218.

A pair of bail pins 224*a* and 224*b* engages the lifting means 218 and power swivel housing 211.

A hydraulic motor 316 connects to the power swivel housing 211.

A valve manifold block 304 fluidly connects to the hydraulic motor 316.

A brake 302 connects to the hydraulic motor 316.

The power swivel assembly has a stem 300 for connecting to a tubular 301 which can be drill pipe.

A low pressure hydraulic oil source 99 provides hydraulic oil through short hose 50 and check valve 52 to the bonnet and reservoir housing 100.

As shown in earlier detailed figures, the bonnet and reservoir housing for the power swivel has a dual seal assembly 112 with a dual fluid reservoir 114 with an oil side 124 for containing hydraulic oil 121 and a mud side 126 containing drilling mud 132.

The dual seal assembly 112 seals against a washpipe 9.

Four long hoses 117 and a 4 hose reel 123 are used in this embodiment.

The remote hydraulic power unit 119 is also labeled in this Figure.

For the power swivel, a separating piston 120 is also positioned between the oil side 124 and mud side 126, the separating piston configured to move as hydraulic oil depletes while maintaining equal pressure of hydraulic oil and drilling mud.

For the power swivel, the hydraulic oil refills automatically from the local onboard hydraulic oil source without requiring an additional long hose or more than four long hoses total or a hose reel with more than four hoses to the remote hydraulic power unit and wherein a refill into the dual fluid reservoir occurs each time the drilling fluid pressure is turned off or drops below oil pressure.

The oil refill occurs automatically because low pressure oil is always available when the system is running and because mud pump pressure is turned off routinely during drilling operations thereby causing a refill.

For the power swivel, the high pressure dual seal assembly 112 seals against the washpipe 9 and fluidly connects to the oil side of the dual seal assembly described with a wavy edged hydrodynamic partitioning seal 130 separating drilling mud from hydraulic oil flowing from the oil side without a differential pressure across the seal; and a wavy edged hydrodynamic high pressure seal 140 separating hydraulic oil 125 from air 133 at atmospheric pressure with full differential pressure across the seal; and wherein the oil side of the dual fluid reservoir is refilled automatically when the drilling mud pump turns off and drilling mud pressure decreases below oil pressure.

In embodiments, the hydraulic fluid onboard the power swivel is the hydraulic fluid used for powering all functions of the power swivel.

FIG. 2 also depicts the drilling mud entering through a pair of mud ports 27*a* and 27*b* into the mud side.

For the power swivel, the lower port 27*a* allows mud drainage by gravity so that hardened mud does not restrict piston movement after a long period of time, and the upper port 27*b* allows air to escape when filling with mud.

Additional Examples of the Invention

As an example of the invention, the invention can be top drive, such as a Venturetech™ ZK-250, with a washpipe of 3" diameter and high pressure seal assembly receiving high pressure drilling fluid from a mud pump, with a hydraulic motor assembly, such as a radial piston type; and an elevator, such as a 250 Ton hydraulic-powered elevator for supporting drill pipe, such as a 5" O.D., 19.50 pounds per foot, S135 metal grade, NC-50 (4½" IF) tool joint of drill pipe, and for engaging a pair of links, such as Venturetech™ made 11' long 250 Ton links.

Yet another example of the invention can be a top drive, such as a Venturetech™ ZK-150 as shown in the Figures, with a washpipe 9 with a 3" diameter and high pressure seal assembly receiving high pressure drilling fluid from a mud pump, having a hydraulic motor assembly 13, such as a radial piston type, an elevator 11, such as a 150 Ton hydraulic-powered elevator for supporting drill pipe 24, such as a 4½" O.D. pipe, 16.60 pounds per foot, S135 grade of metal, NC-46 (4" IF) tool joint of drill pipe, and for engaging a pair of links 12*a*, 12*b*, such as Venturetech™ made 11' long 250 Ton links.

The invention can be a power swivel, such as a Venturetech™ XK-100, can be attached to a travelling block and hook of a drilling rig for drilling a wellbore. The power swivel can be supported with a lifting means, such as an elevator bail. The power swivel can have a power swivel housing engaging the lifting means. In this example, a pair of bail pins can be used each having a diameter of 2" for engaging the lifting means and power swivel housing, such as a housing load rated for 100 Tons.

In this example, the hydraulic motor can be a vane type hydraulic motor.

A valve manifold block can be used such as one made from alloy steel and containing a Hot Oil Shuttle Valve (HOSV), fluidly connected to the hydraulic motor.

In this example, the power swivel can have a brake, with eight friction discs, connected to the hydraulic motor and a stem, such as a stem with a 2⅞" IF pin connection, for connecting to a tubular, such as a 2⅞" O.D., 10.40 pounds per foot, S135 grade of metal. 2⅞" IF (NC-31) tool joint of drill pipe.

In another example of the invention as a power swivel can be a Venturetech™ brand XK-150, attached to a traveling block and hook of a drilling rig for drilling a wellbore.

The power swivel can have a lifting means, such as an elevator bail; a power swivel housing engaging the lifting means; a pair of bail pins each with a diameter of 2½" engaging the lifting means and power swivel housing, such as a housing load rated for 150 Tons.

The power swivel can have a hydraulic motor, such as a radial piston type hydraulic motor, a valve manifold block, made from alloy steel and containing a Hot Oil Shuttle Valve (HOSV), fluidly connected to the hydraulic motor.

The power swivel can have a brake, with eight friction discs, connected to the hydraulic motor; a stem such as a stem with a 4" FH pin connection, for connecting to a tubular, such as a 4" O.D., 14.00 pounds per foot, S135 metal grade, and NC-40 (4" FH) tool joint of drill pipe.

As yet another example, the invention can include a power swivel, such as a Venturetech™ XK-250, attached to a lifting means of a drilling rig for drilling a wellbore, having: a lifting means such as a pair of 250 Ton API links; a power swivel with a power swivel housing engaging the lifting means; a pair of bail pins with a diameter of 3.250" engaging the lifting means and power swivel housing, such as a housing load rated for 250 Tons; a hydraulic motor, such as a radial piston hydraulic motor, engaging the power swivel housing; a valve manifold block, made from alloy steel and containing a Hot Oil Shuttle Valve (HOSV), fluidly connected to the hydraulic motor, a brake, with eight friction discs, connected to the hydraulic motor; a stem, such as a stem with a 4½" IF pin connection, for connecting to a tubular 301, such as a 5" O.D., 19.50 pounds per foot, S135 type of metal, NC-50 (4½ " IF) tool joint of drill pipe.

While these embodiments have been described with emphasis on the embodiments, it should be understood that within the scope of the appended claims, the embodiments might be practiced other than as specifically described herein.

What is claimed is:

1. A top drive for drilling a wellbore, comprising:

lifting means for engaging a hoist;

a first housing connected to the lifting means;

a hydraulic motor assembly mounted to the first housing;

a stem extending from the first housing and rotatable by the hydraulic motor assembly;

an elevator connected to a pair of links for suspending drill pipe;

a bonnet and reservoir housing mounted to the top drive, comprising:

a dual fluid reservoir having an oil side for containing hydraulic oil and a mud side for containing drilling mud;

a separating piston positioned between the oil side and the mud side, the separating piston configured to move as hydraulic oil depletes while maintaining equal pressure of hydraulic oil and drilling mud; wherein hydraulic oil refills the oil side automatically through a hydraulic oil source hose and check valve from the hydraulic oil source without requiring more than four hoses or more than a four hose reel connected to supply hydraulic oil from a remote hydraulic power unit to the hydraulic motor assembly and wherein the refill of the hydraulic oil reservoir occurs each time the drilling fluid pressure is turned off or drops below the oil pressure, whereby the drilling mud pressure is conducted through holes and in the bonnet and reservoir housing into the mud side thereby transmitting the drilling mud pressure through the separating piston to equalize the drilling mud and hydraulic oil pressures in the dual fluid reservoir, such that the hydraulic oil pressure is maintained for use in dual seal assembly by the check valve, the check valve providing one-way entry of the hydraulic oil from the hydraulic oil source; and a washpipe dual seal assembly engaging a washpipe, the washpipe dual seal assembly being in fluid communication with the oil side and receiving the hydraulic oil, the washpipe dual seal assembly comprising:

a partitioning seal that separates the drilling mud from the hydraulic oil without a differential pressure across the partitioning seal; and a pressure seal that separates the hydraulic oil from outside the bonnet and reservoir housing with a differential pressure across the pressure seal.

2. The top drive of claim 1, wherein the top drive comprises:

an internal blow out preventer connected to the stem;

a back up torque wrench connected to the first housing and engaging the drill pipe;

a brake connected to the first housing;

a pair of bail pins for securing the lifting means to the first housing; and a hydraulic manifold connecting the hydraulic oil source to the hydraulic oil source hose.

3. The top drive of claim 1, wherein the four hoses or the four hose reel fluidly engage the remote hydraulic power unit or a four hose reel.

4. The top drive of claim 1, wherein the washpipe dual seal assembly further comprises:

the partitioning seal, the partitioning seal comprising a wavy edged hydrodynamic partitioning seal for said separation of the drilling mud from the hydraulic oil without differential pressure across the partitioning seal; and the pressure seal, the pressure seal comprising a wavy edged hydrodynamic pressure seal for said separation of the hydraulic oil from the air outside the bonnet and reservoir housing with the differential pressure across the high pressure seal; and wherein said automatic refill of the oil side of the dual fluid reservoir occurs when the drilling mud pressure decreases below the hydraulic oil pressure.

5. A power swivel assembly for drilling a wellbore, comprising:

a lifting means;

a power swivel housing engaging the lifting means;

a hydraulic motor engaging the power swivel housing;

a valve manifold block fluidly connected to the hydraulic motor;

a stem for connecting to a tubular;

a low pressure source of hydraulic oil providing hydraulic oil;

a short onboard hose for transferring hydraulic fluid from the hydraulic oil source through a check valve to the oil side of a dual fluid reservoir;

a bonnet and reservoir housing mounted to the power swivel, comprising:

a dual fluid reservoir having an oil side for containing hydraulic oil and a mud side for containing drilling mud;

a separating piston positioned between the oil side and the mud side, the separating piston configured to move as hydraulic oil depletes while maintaining equal pressure of hydraulic oil and drilling mud; wherein hydraulic oil refills the oil side automatically through a hydraulic oil source hose and check valve from the hydraulic oil source without requiring more than a four hoses or more than a four hose reel to supply hydraulic oil from a remote hydraulic power unit to the hydraulic motor assembly and wherein the refill of the hydraulic oil reservoir occurs each time the drilling fluid pressure is turned off or drops below the oil pressure; and whereby the drilling mud pressure is conducted through holes in the bonnet and reservoir housing into the mud side thereby transmitting the drilling mud pressure through the separating piston to equalize the drilling mud and hydraulic oil pressures in the dual fluid reservoir, such that the hydraulic oil pressure is maintained for use in dual seal assembly by the check valve, the check valve providing one-way entry of the hydraulic oil from the hydraulic oil source; and a washpipe dual seal assembly engaging a washpipe, the washpipe dual seal assembly being in fluid communication with the oil side and receiving the hydraulic oil, the washpipe dual seal assembly comprising:

a partitioning seal that separates the drilling mud from the hydraulic oil without a differential pressure across the partitioning seal; and a pressure seal that separates the hydraulic oil from outside the bonnet and reservoir housing with a differential pressure across the pressure seal.

6. The power swivel of claim 5, wherein the washpipe dual seal assembly further comprises:

the partitioning seal, the partitioning seal comprising a wavy edged hydrodynamic partitioning seal for said separation of the drilling mud from the hydraulic oil without differential pressure across the partitioning seal; and the pressure seal, the pressure seal comprising a wavy edged hydrodynamic pressure seal for said separation of the hydraulic oil from the air outside the bonnet and reservoir housing with the differential pressure across the pressure seal; and wherein said automatic refill of the oil side of the dual fluid reservoir occurs when the drilling mud pressure decreases below the hydraulic oil pressure.

7. The power swivel of claim 5, wherein the power swivel comprises:

a pair of bail pins connecting the lifting means to the power swivel housing; and a brake connected to the hydraulic motor.

8. The power swivel of claim 5, wherein the four hoses or the four hose reel fluidly engage the remote hydraulic power unit or a four hose reel.

* * * * *